United States Patent [19]

Schulze, Jr.

[11] 4,265,170

[45] May 5, 1981

[54] SOLENOID ACTUATED CONTAINER CRUSHER

[76] Inventor: Everett E. Schulze, Jr., 1700 Jasper St., Suite E, Aurora, Colo. 80011

[21] Appl. No.: 68,479

[22] Filed: Aug. 21, 1979

[51] Int. Cl.[3] ..... B30B 9/32

[52] U.S. Cl. ..... 100/49; 100/DIG. 2; 100/91; 100/116; 100/215; 100/218; 100/266; 100/295; 100/DIG. 17; 194/4 R; 241/99

[58] Field of Search ..... 100/DIG. 2, DIG. 17, 100/266, 116, 215, 218, 91, 49, 50, 52, 264, 295, 256, 257; 141/160; 241/99; 194/4 R

[56] References Cited

U.S. PATENT DOCUMENTS

| | | | |
|---|---|---|---|
| Re. 27,643 | 5/1973 | Myers | 100/DIG. 2 |
| 1,284,310 | 11/1918 | Gilbert | 141/160 |
| 2,068,013 | 1/1937 | Fridlender | 100/116 |
| 2,561,169 | 7/1951 | Bickelhaupt | 100/52 |
| 2,707,503 | 5/1955 | Johnson | 100/DIG. 2 |
| 2,780,987 | 2/1957 | Wall | 100/52 X |
| 3,034,422 | 5/1962 | McHowell | 100/DIG. 2 |
| 3,062,130 | 11/1962 | Huber | 100/DIG. 2 |
| 3,792,765 | 2/1974 | Arp | 100/DIG. 2 |
| 3,911,807 | 10/1975 | Birnbaum | 100/218 |
| 3,916,780 | 11/1975 | Heiser | 100/DIG. 2 |
| 4,091,725 | 5/1978 | Arp | 100/DIG. 2 |
| 4,141,493 | 2/1979 | Arp | 100/DIG. 2 |

*Primary Examiner*—Billy J. Wilhite
*Attorney, Agent, or Firm*—Richard D. Law

[57] ABSTRACT

A one at a time can crusher, specifically for recycling aluminum cans, includes an aligning and separating feed chute for cans leading to an end-to-end crusher, and a contact arrangement for detecting the type of can, actuates a solenoid crusher. The unit includes storage for a large number of crushed cans, and a magnetic metal and glass rejector, with an overweight can rejector when used for aluminum.

8 Claims, 7 Drawing Figures

SOLENOID ACTUATED CONTAINER CRUSHER

The use of glass and metal cans is currently wide spread for various beverages and foods. Aluminum is an acceptable container for items of human consumption and is advantageous because of lightness. The aluminum from such containers is a readily recyclable metal, particularly as the aluminum does not deteriorate at a rate which would essentially degrade the metal to an oxide, under normal conditions. The cans, however, have created a litter problem as they are easily discarded, but do not biodegrade in an acceptable time frame. Some recycling has been accomplished by payment to persons conveying the cans to a collection center. This is disadvantageous as collection centers tend to be wide spread, making travel to the center sometimes more expensive than the recovered payment for the cans. Also, the center normally pays for the cans on a pound basis, which requires a scale, a supply of cash, containers for the cans, attendents, etc.

Magnetic metal cans, that is ferrous metal containers, are recyclable, but in the past have not enjoyed much attention probably due to the relative non-crushability without special equipment. As ferrous ores decrease, a market is available to collectors of the ferrous cans. This aids the ecology of urban areas by substantially disrupting the discarding of such cans in indiscriminate ways. Glass containers, even the non-return type, contain usable material. If collection costs are reduced, such materials become a viable source for the crushed glass, etc.

Containers for food and beverages are bulky, for the weight involve, in their full capacity condition. Collection of empty containers is enhanced by reducing, as by crushing, the size of the containers. Obviously, large scale compacting cans or crushing bottles may be accomplished by large machines using rollers, hammer mills, crusher plates, etc., but the problem of accumulation at the location, the collection and transportation, etc. of the containers of the large compactor remains.

THE PRESENT INVENTION

The present invention is a very low energy consumption container compactor, specifically arranged for a single one-at-a-time container crushing operation. The unit may be easily provided with a coin or coupon dispenser upon the acceptance of a container, and may be adapted for dispensing different denominations of coins or coupons for different sizes of containers.

The unit having a minimum of moving parts includes a gravity chute for a container, placing the container on a receiving bed and means for actuating at least one solenoid to crush the container between a moving head and a stationary anvil. The solenoid is fired for a fraction of a second, as the major energy consumption. Crushed containers fall by gravity to a storage bin. If a premium dispenser is attached, it, of course, requires a very small amount of electrical current to dispense the premium.

The invention, described below, is in relation to aluminum cans, however, the unit is adapted to crush ferrous metal cans, glass bottles, plastic bottles, or other containers. The huge volume of aluminum cans, however, provides a ready recyclable product, with a wide choice of locations for the collection. It is intended that with minor changes the unit is useful for crushing such other containers. The terms "crushing" and "compacting" are used generally interchangeable to indicate a substantial reduction in size of the container. Any discussion directed to aluminum cans, obviously, is intended to cover ferrous metal cans, glass containers, etc.

OBJECTS AND ADVANTAGES OF THE INVENTION

Included among the objects and advantages of the invention is to provide a dependable, rugged, low maintanence can crusher with very few moving parts, and very low energy consumption.

Another object of the invention is to provide a solenoid actuated head, crushing a container against an anvil.

Still another object of the invention is to provide a low energy-consuming can crusher with a minimum of wearable parts, and which is easy to clean and maintain.

Yet another object of the invention is to provide a pair of parallel solenoids acting in unison to move a crushing head toward an anvil.

A further object of the invention is to provide a simple inexpensive can crusher having a gravity feed, with a container sorting arangement for undesirable cans and trash, a solenoid actuated can crusher, a gravity discharge for crushed cans and a spring return device for the can crusher.

An additional object of the invention is to provide an aluminum can crushing device, actuated by solenoids, arranged to automatically determine the length of can to be crushed and hereby provide actuation of other mechanism according to the length of the can.

These and other objects and advantages of the invention may be ascertained by reference to the following description and appended illustrations.

GENERAL DESCRIPTION OF THE DRAWINGS

DETAILED DESCRIPTION OF THE DRAWINGS

Figure 1:
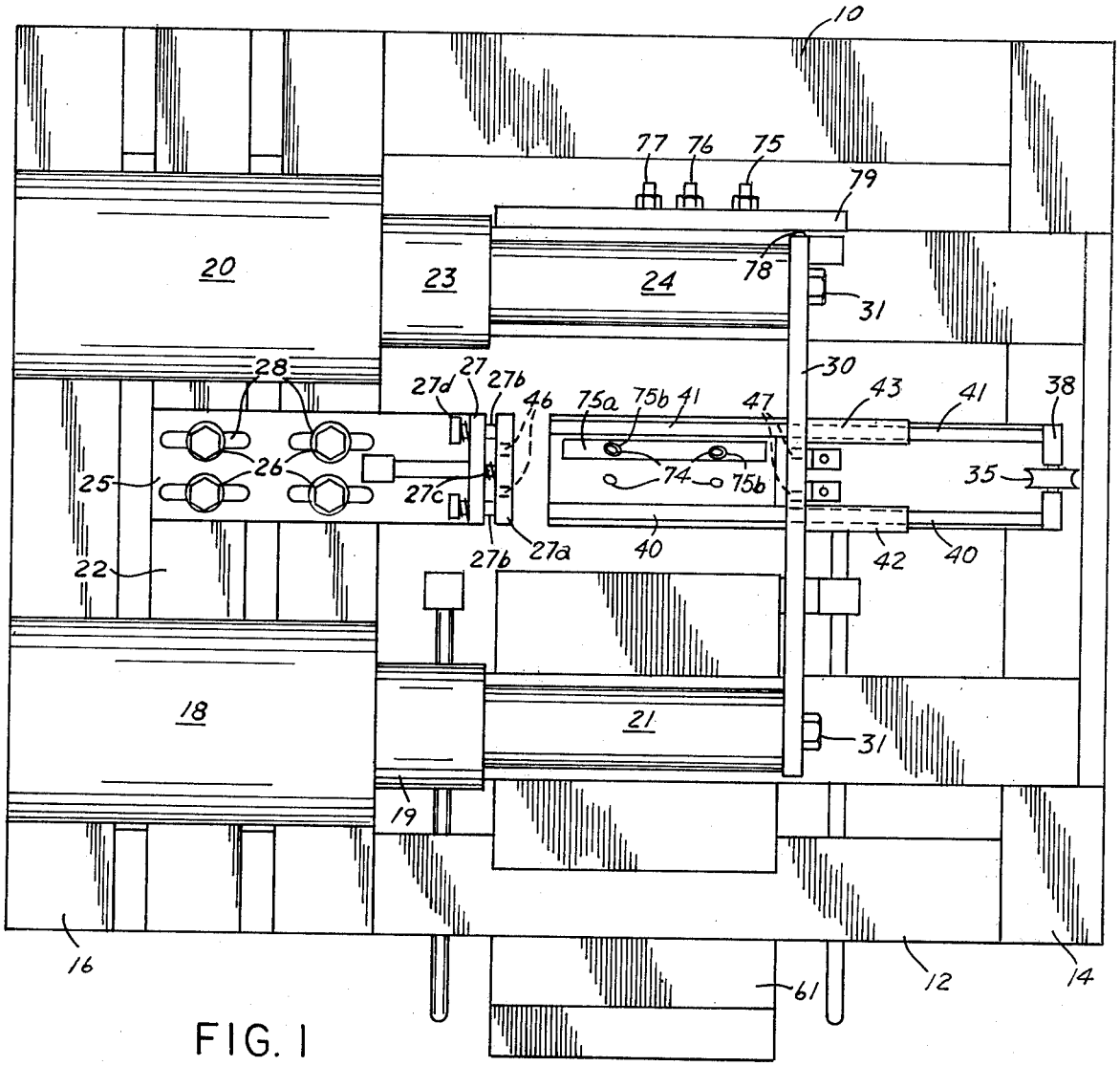
FIG. 1 is a top plan view of a double solenoid container crushing device according to the invention.
Figure 4:
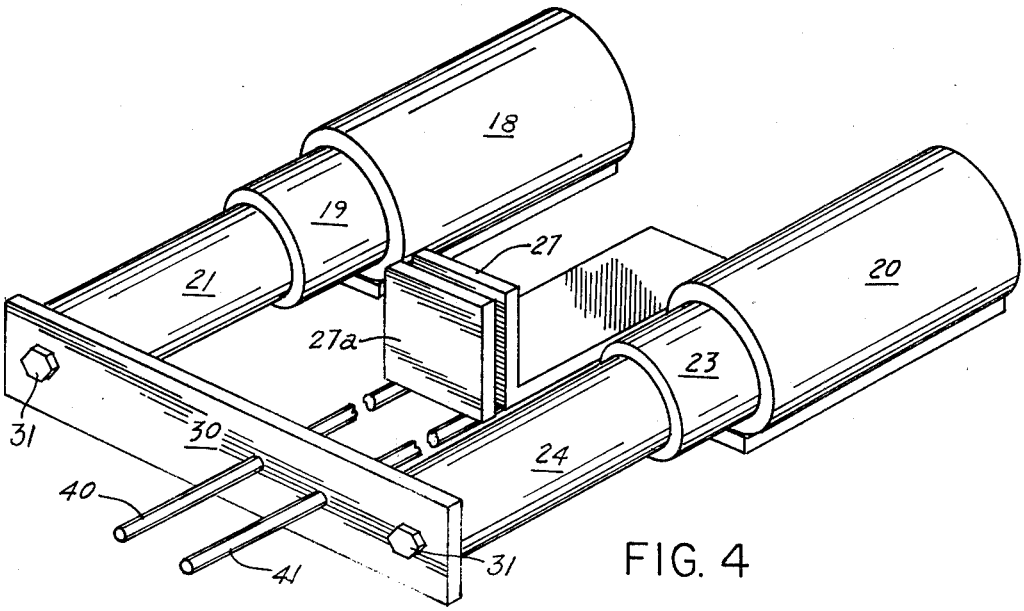
FIG. 4 is a schematic perspective of the major components of a container crushing device according to the invention.
Figure 2:
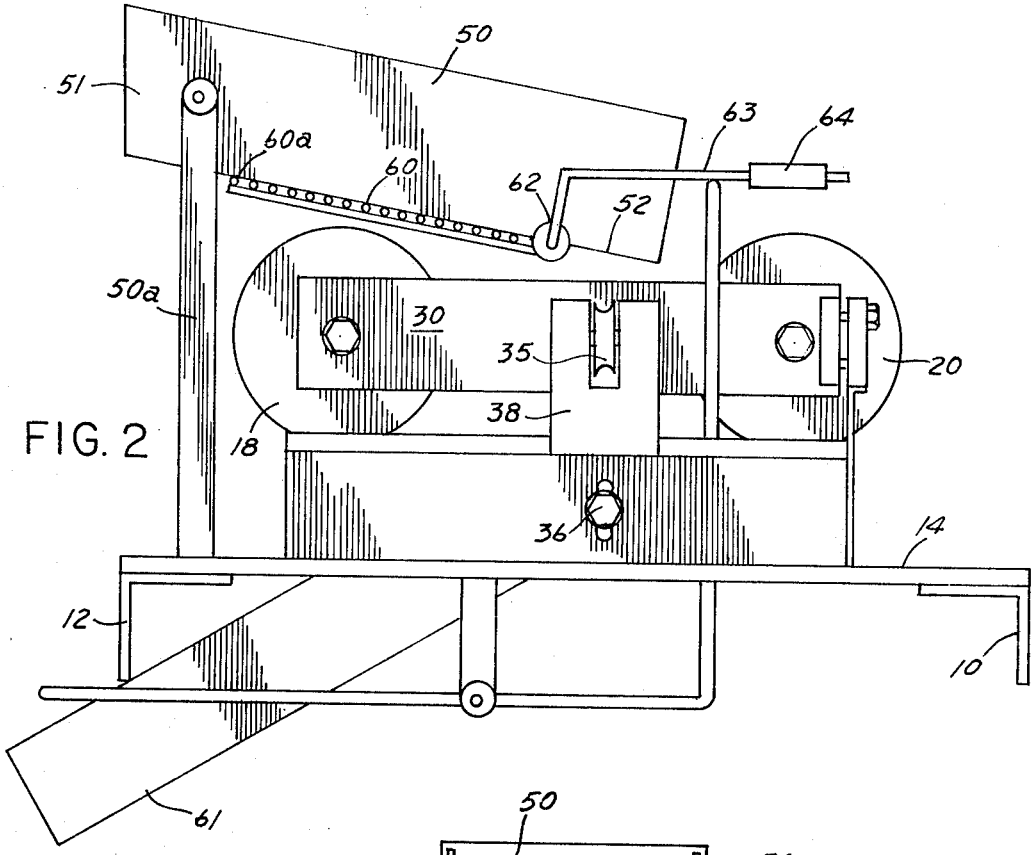
FIG. 2 is an end elevational view of the device of FIG. 1.

In general, the crusher includes a movable crushing element, a solenoid actuating mechanism for the crushing element and an anvil against which the container is crushed. The electric circuitry is quite simple, so the mechanism may be made in a modular form for easy and quick mounting or dismounting from a frame work. In one form, the crush unit may be mounted on a frame which part of a housing which may be locked against unauthorized access. Thus, a simple chute opening, for cans to be crushed, is available to the users, preventing access to the areas where injury may occur. Further, if the crusher is housed with a dispenser for coins or coupons for received cans, both the crusher and dispenser may be modular for the easy assembly or disassembly of the unit.

The unit shown in FIGS. 1–5 includes a mounting frame which is a peripheral frame having side members 10 and 12, front end member 14 and back member 16 all joined together, leaving a central opening. A pair of solenoids 18 and 20 are mounted on lateral bars 17 mounted on back frame member 16. An anvil mounting plate 25, secured to bars in space 22 between the solenoids, is reciprocable in relation to the back frame member. This plate is adjustably secured in place by bolts 26, mounted through elongated slots 28 which permit the plate 25 and a carried anvil plate 27 to be adjusted. The coils of the solenoids are mounted in the solenoid housings 18 and 20, leaving a central bore, in accordance with solenoid construction. A non-magnetic sleeve 19 is secured in the bore of coil housing 18, and a core or armature 21 is arranged for reciprocation in the sleeve. In like manner, a sleeve 23 in bore of coil 20 has a reciprocating core or armature 24 therein. The outer ends of the two cores are secured to crusher bar 30 by means of bolts 31 so as to reciprocate with the solenoids. Since the core tends to center in the coil firing, little or no wear will result from extended use. The container crusher bar 30 moves toward the anvil 27 under power by the solenoids, and it is returned, in the absence of electrical power on the solenoids by a spring 34 passing over a pulley or arcuate rest 35 with the outer end secured to bolt 36. The pulley 35 is mounted in upstanding frame member 38 which support can resting rods 40 and 41. The crusher bar 30 is secured by bolts 31 to the cores of the solenoids, and the solenoids are arranged to act in unison. A sleeve 42 around rod 40 and a sleeve 43 around rod 41 are secured to crusher bar 30. The rods 40 and 41 pass through the crusher bar, (which reciprocates on the rods) and terminate short of the anvil. The rods are parallel and spaced apart acting as a cradle to support an aluminum beverage can on its side between the crusher bar on the anvil. For adequate crushing, the bar and anvil must be wider than the diameter of the can. To prevent trapped air and/or liquid, bores 46 in the anvil and bores 47 in crusher bar 30 permit escape of air and liquid. Tubes (not shown) of rubber, flexible plastics, etc., may be placed in the holes leading to a container for the liquid.

The anvil may be a single element or a double element to actuate a switch. A double element is shown where an anvil face **27*a* is spring biased away from anvil 27. The face 27*a* is mounted on four depending studs 27*b* having stops 27*d*, with spring 27*c* between the anvil and movable face, biasing face 27*a* away from anvil 27. A switch, 74*a*, FIG. 3, mounted on plate 25 is closed as the face moves back toward the anvil 27, providing means for actuating a circuit as described below. The can supporting rods terminate short of face 27*a*** in its extended position, and the cans crushed by the crusher bar fall through the space at the ends of the rods. The spring loaded anvil face aids the discharge of the crushed can as it returns to its forward or extended position.

To insure that empty aluminum cans are correctly placed in the crushing cradle (on the rods 40 and 41) a low-slope gravity chute 50 feeds cans into the cradle. The chute includes a mouth 51 and a lower discharge 52 emptying into the cradle. A can feeder 54, FIG. 3, includes a hollow cylinder 55, with a can sized cut-out 56 to permit entry of a standard diameter beverage can, is pivoted on pivots 57 and 58 in a frame mounted on a housing shown partially at **54*a* of FIG. 5 having an opening 54*b* for the feeder. A disc turning mechanism 59, which may be attached through connecting means to a hand lever, is arranged to rotate the hollow cylinder 55 to release its single can content into chute 50 in a horizontal position so that rolls down the chute to the discharge. The opening 56** of the cylinder is only slightly wider than the diameter a beverage can to prevent large objects being inserted into the machine, and its length may accommodate the can to be crushed. Magnets in the hollow cylinder will prevent inserting iron cans or magnetic materials into the crusher. Such paramagnetic materials will be retained in the feeder until extracted.

Figure 3:
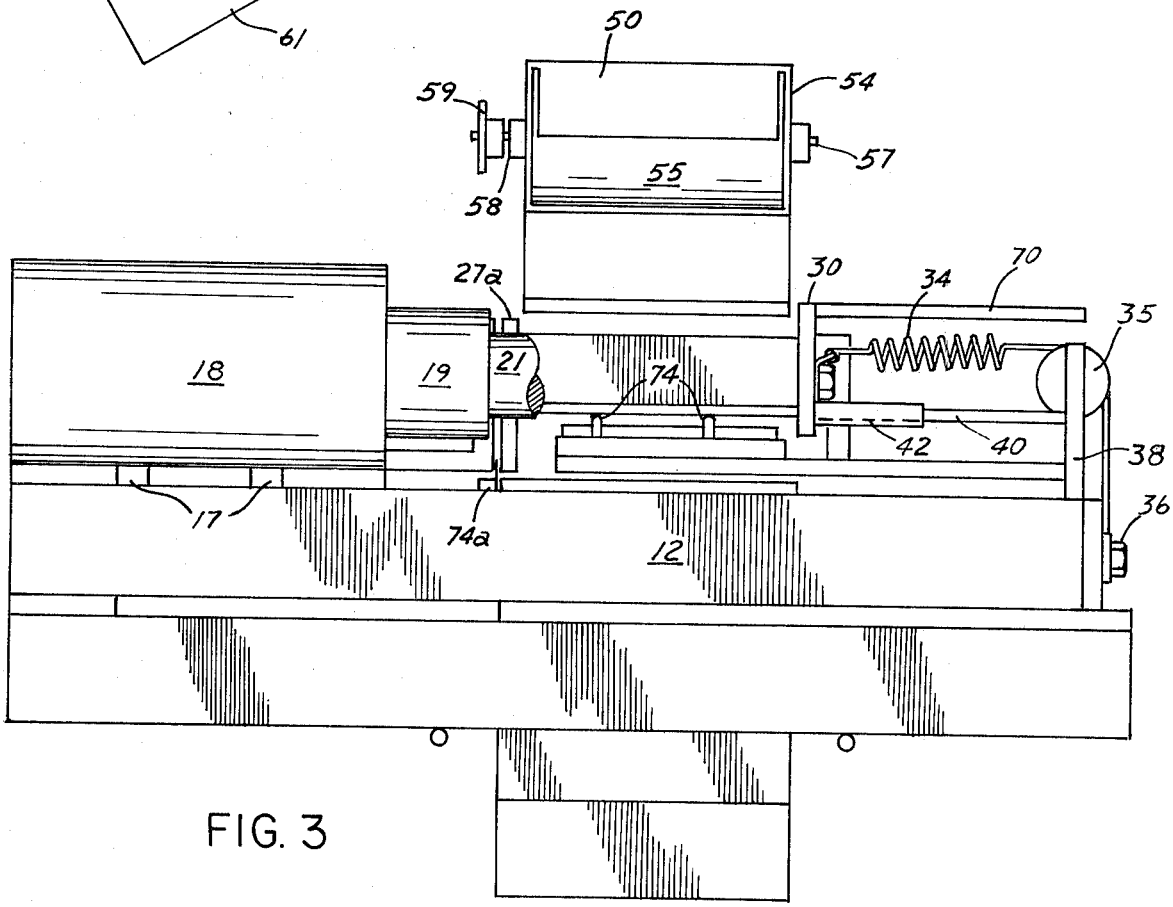
FIG. 3 is a side elevational view, partially cut away, of the device of FIG. 1.
Figure 5:
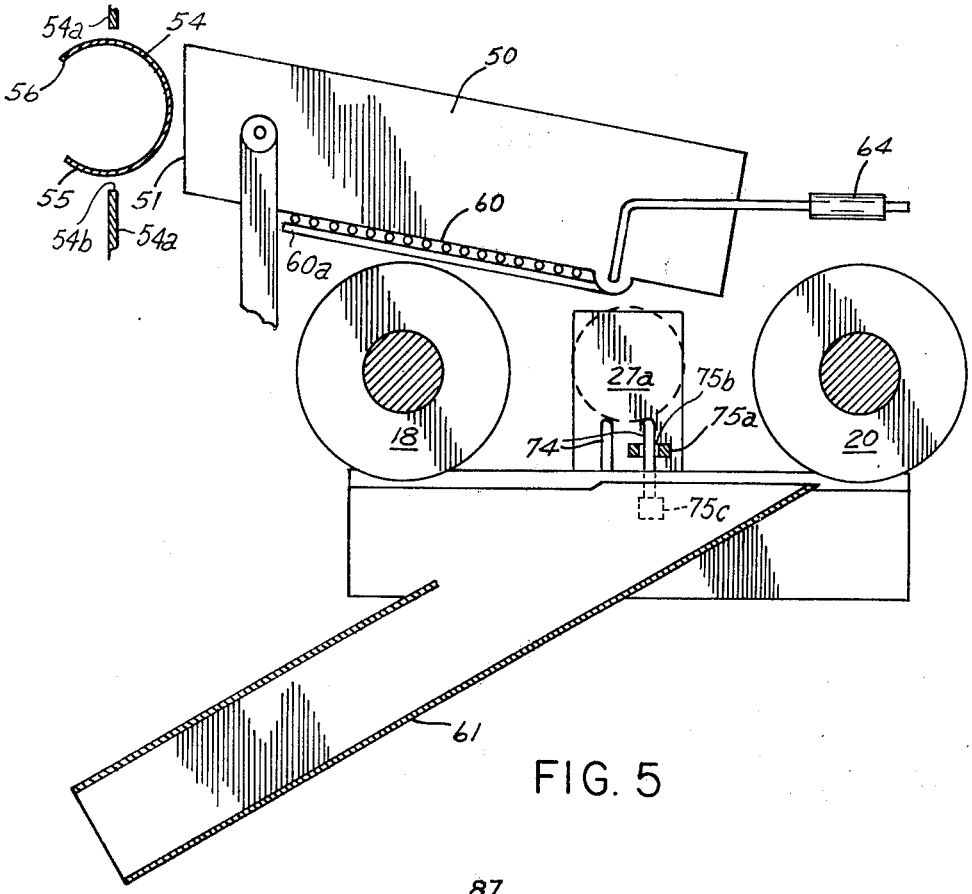
FIG. 5 is schematic, partially cut-away end view of a container according to the invention.

On the bottom wall of the chute 50 is mounted a pivoted grate 60 which permits small objects to drop through the grating to a discharge chute 61, therebelow. The grate is pivoted at its lower end by pivot 62 which permits the front **60*a* grate to drop downwardly discharging material into the discharge chute 61. A balance arm 63 with an adjustable weight 64 mounted on it, determines the weight of object which will trip the trap door grate. Aluminum cans usually are made in 6, 7, 8, 12 and 16 ounce capacity size, and the weight 64 may be moved to just pass the 16 ounce size, normally the largest beverage cans. Anything heavier will trip the trap door. Any aluminum can with included weight, e.g. liquid, sand, trash, etc. will be rejected by the trap door. The chute 50 is supported in position by uprights 50*a* extending from the base to the chute. A tray 70, FIG. 3, is mounted on the pusher bar 30 and extends over the spring (the actual attachment being shown in FIG. 3, and the tray is not shown in the other view for clarity). This tray reciprocates with the crusher bar 30** and eliminates multiple cans from stacking up in the crusher. If a can immediately follows a can in the cradle, the tray catches the second as the travels with crusher bar. On the return of the crusher bar, the crushed can drops, and the can on the tray is pushed off so it falls on the positioning rods.

Figure 7:
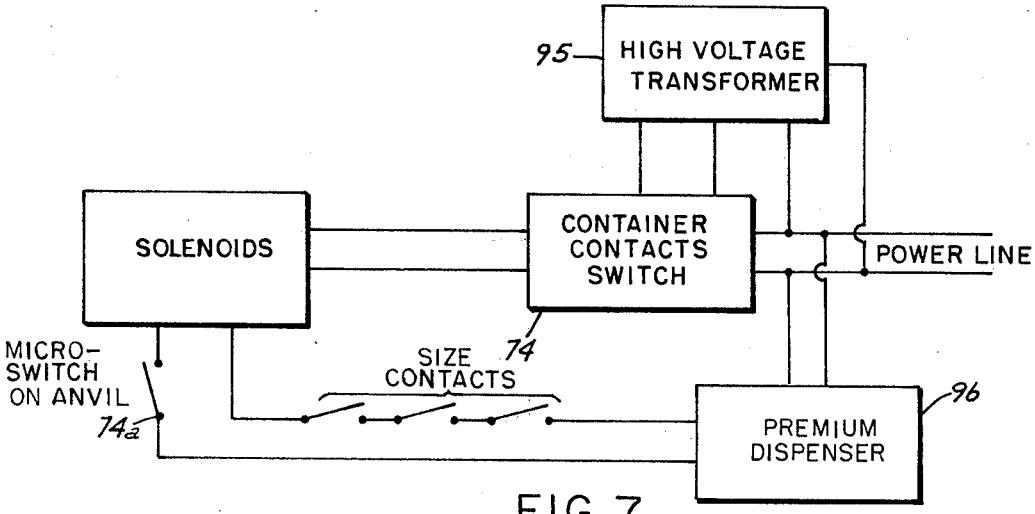
FIG. 7 is a schematic circuit diagram for the unit.

A micro-switch **74*a* with an arm is mounted to close when the spring loaded plate 27*a* is pushed back against anvil plate 27. Such a switch may be used in a circuit to actuate a coupon or coin dispenser. The circuit includes contacts 75, 76 and 77 (passing through frame member 79) which are activated by a contact 78 on the crusher bar 30. As a can is lying on the positioning rods, the micro-switch on the anvil is open. After activation, the crusher bar pushes against the can, and when the can is starting to be crushed, the spring loaded plate 27*a* is pushed back against the anvil, closing the microswitch. The position of the crusher bar, when the microswitch is closed, activates a current by contact of contact 78 with one of the contacts 75, 76 or 77. These contacts are spaced to fit the particular size of a can, thus, point 75 is for the largest can to be crushed and 77 is for the smallest, and 76 is for an intermediate size can. These may be connected to a dispensing device 96, FIG. 7, to dispense the requisite denomination of coupons or coins, for example, 3 coupons for the largest can, 2 for the intermediate size and 1** for the smallest.

The solenoids are activated by an aluminum can touching contact points 74. These are four in number and spaced so that at least two opposed points contact even the smallest can. An aluminum can touching two opposed points will trigger the switch for the solenoid circuit. The firing of solenoid circuit provides enough current for the retraction of solenoid cores carrying the crusher bar. As soon as the can, being crushed, goes out of contact with points, the circuit is opened so no further flow of electricity goes to the solenoids and the spring returns the crusher bar. By using a high frequency voltage, from transformer 95, FIG. 7 for example 3000 volts, but at little or no amperage, the points in contact with metal close a power switch to trigger the solenoid power circuit, even though plastic coated aluminum cans. Such a circuit will not trigger the power circuit for non-metallic cans.

A reject button or lever (not shown) may be added to the unit to activate a small solenoid 75*c*, attached to the reject bar 75*a* which is reciprocable on the contacts 74 by bores 75*b* in the bar, to push the bar 75*a* to the top points of the contacts to discharge non-metallic items in the cradle into the reject chute 61.

Figure 6:
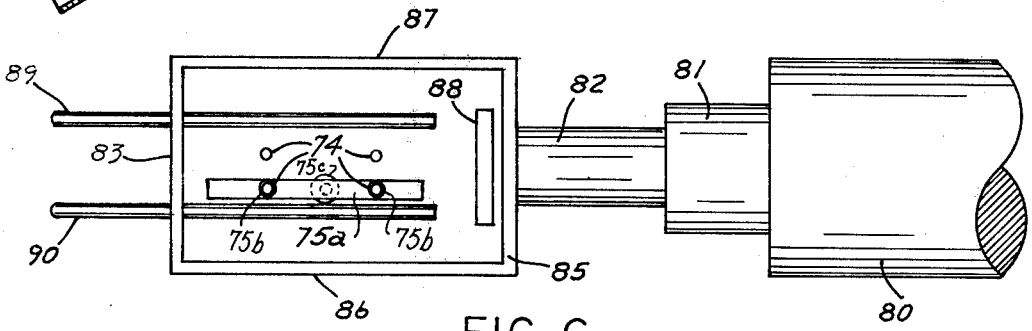
FIG. 6 is a top plan view, generally schematic, of a modified form of a container crusher according to the invention.

In the place of the two solenoids, a single solenoid may be used, as shown in FIG. 6. In this case, a single solenoid 80 with an aluminum slide tube 81 for a core 82 drives a crushing bar 83. This bar 83 is secured to the ends of a yoke consisting of a core mounted bar 85 and yoke legs 86 and 87. The crusher bar moves toward anvil 88. A can cradle is provided by positioning rods 89 and 90 over which the bar 85 slides, as described above. Contact points 74 are mounted in the cradle for contacting a can, and a reject bar 75*a* is, FIG. 5, also, mounted in the cradle.

The unit is conveniently placed in a housing having a door through which a wheeled container or barrel will pass. This container rests below the crushing unit so that crushed cans fall into the container. This permits a full container to be removed and an empty container replaced in the housing, easily and simply. Also, it is apparent the power circuit may be a simple plug-in connection so that the unit as a module is easily put in or taken out of a housing.

What is claimed is:

1. A small container crushing assembly comprising:

(a) frame means, (b) holder means inclusive of a pair of horizontal, spaced rods mounted on said frame means for a container to be crushed, supporting such container in a longitudinal position, (c) anvil means against which an end of a container is crushed mounted adjacent one end of said holder means, including a limited movement face means normally spring biased away from said anvil means and movable to said anvil means under influence of a container being crushed, (d) flat faced crusher bar means mounted normally to said pair of rods arranged to reciprocate toward and away from said anvil means, and (e) solenoid motivating means including at least one coil and a plunger interconnected with said crusher bar means for reciprocating the same toward said anvil means on activating said solenoid motivating means to draw said at least one plunger in said at least one coil of said solenoid motivating means for crushing a container on said holder means under full force of said solenoid motivating means.

2. A small container crushing assembly according to claim 1, wherein switch means are mounted in position to be actuated by movement of said face means whereby said face means actuates mechanism according to the length of the held can in conjunction with the container crushing.

3. A small container crushing assembly according to claim 2, wherein a plurality of contacts are mounted adjacent said crusher bar means connected to a plurality of non-actuating crusher circuit means and progressively actuated by the position of said crusher bar when said switch means is activated by said face means.

4. A small container crushing assembly according to claim 1, wherein said anvil means and said crusher bar are perforated in the area of can contact with small air release holes for release of air on crushing a container.

5. A small container crushing assembly according to claim 1, wherein said solenoid motivating means includes two coacting solenoids, with one connected to each end of said crusher bar means.

6. A small container crushing assembly according to claim 1, wherein said crusher bar means includes yoke means connected to a single solenoid.

7. A small container crushing assembly according to claim 1, wherein pusher bar means is mounted adjacent and below said holder means and reciprocable toward said holder means for rejecting a can resting on said holder means.

8. A small container crushing assembly according to claim 1, wherein said holder means includes said spaced rods terminating short of said anvil means and said normally spring biased said face means providing gravity release means for crushed containers, and gravity chute means for discharge of non-crushed containers.

* * * * *